US009889570B2

(12) United States Patent
Haba

(10) Patent No.: US 9,889,570 B2
(45) Date of Patent: Feb. 13, 2018

(54) RAZOR WITH ATTACHED SHAVING AID

(71) Applicant: KAI R&D CENTER CO., LTD., Gifu (JP)

(72) Inventor: Daisuke Haba, Seki (JP)

(73) Assignee: KAI R&D CENTER CO., LTD. (JP)

( * ) Notice: Subject to any disclaimer, the term of this patent is extended or adjusted under 35 U.S.C. 154(b) by 177 days.

(21) Appl. No.: 14/439,042

(22) PCT Filed: Nov. 5, 2013

(86) PCT No.: PCT/JP2013/079818

§ 371 (c)(1),
(2) Date: Apr. 28, 2015

(87) PCT Pub. No.: WO2014/073502

PCT Pub. Date: May 15, 2014

(65) Prior Publication Data

US 2015/0290820 A1 Oct. 15, 2015

(30) Foreign Application Priority Data

Nov. 6, 2012 (JP) ..... 2012-244027

(51) Int. Cl.
*B26B 21/44* (2006.01)
*B26B 21/40* (2006.01)

(52) U.S. Cl.
CPC ..... *B26B 21/443* (2013.01); *B26B 21/4012* (2013.01); *B26B 21/4025* (2013.01); *B26B 21/44* (2013.01)

(58) Field of Classification Search
CPC ... B26B 21/443; B26B 21/44; B26B 21/4012; B26B 21/4025
See application file for complete search history.

(56) References Cited

U.S. PATENT DOCUMENTS 2,677,883 A * 5/1954 Schallgruber ..... B26B 21/44 15/DIG. 3
3,895,437 A * 7/1975 DiBuono ..... B26B 21/44 15/244.2

(Continued)

FOREIGN PATENT DOCUMENTS

CN 102216040 A 10/2011
JP 200319372 A 1/2003

(Continued)

OTHER PUBLICATIONS

International Search Report for PCT/JP2013/079818, dated Feb. 10, 2014, pp. 1-2.

(Continued)

*Primary Examiner* — Hwei C Payer
(74) *Attorney, Agent, or Firm* — Tarolli, Sundheim, Covell & Tummino LLP

(57) ABSTRACT

A razor having an attachment portion and a shaving aid is provided. The attachment portion includes a blade body. The shaving aid is provided with a deformable portion that deforms when contacted by the skin surface. When the razor is used, the shaving aid itself deforms to decrease the frictional resistance between the shaving aid and the skin surface. This improves the tactile sensation on the skin surface and thus the shaving sensation.

16 Claims, 5 Drawing Sheets

(56) References Cited

U.S. PATENT DOCUMENTS

| | | | | |
|---|---|---|---|---|
| 3,969,817 | A * | 7/1976 | DiBuono | B26B 21/44 30/41 |
| 4,314,404 | A * | 2/1982 | Ruiz | B26B 21/446 30/41 |
| 4,712,300 | A * | 12/1987 | Hemmeter | B26B 21/44 30/41 |
| 4,850,107 | A * | 7/1989 | Valliades | B26B 21/44 30/41 |
| 6,216,345 | B1 * | 4/2001 | Andrews | B26B 21/22 30/34.05 |
| 8,407,900 | B2 * | 4/2013 | Johnson | B26B 21/4012 30/50 |
| 2002/0157256 | A1 | 10/2002 | Barone | |
| 2006/0080837 | A1 | 4/2006 | Johnson et al. | |
| 2008/0209734 | A1 | 9/2008 | Nicoll | |
| 2009/0307908 | A1 | 12/2009 | Nakasuka | |
| 2010/0122462 | A1 | 5/2010 | Ndou et al. | |
| 2010/0293789 | A1 * | 11/2010 | Kwiecien | B26B 21/443 30/34.05 |
| 2011/0247216 | A1 | 10/2011 | Johnson | |
| 2015/0272852 | A1 * | 10/2015 | Ozawa | C08G 18/6674 424/78.02 |
| 2015/0273708 | A1 * | 10/2015 | Haba | B26B 21/225 30/41 |
| 2015/0290820 | A1 * | 10/2015 | Haba | B26B 21/4012 30/41 |

FOREIGN PATENT DOCUMENTS

| | | | |
|---|---|---|---|
| JP | 2003019372 | | 1/2003 |
| JP | 2007068923 | | 3/2007 |
| JP | 2008110113 | | 5/2008 |
| JP | 2008110113 | A | 5/2008 |
| JP | 2008516677 | A | 5/2008 |
| JP | 2010518941 | A | 6/2010 |
| JP | 4921747 | B2 | 4/2012 |
| WO | WO 94/04325 | A1 | 3/1994 |
| WO | 2008053814 | A1 | 5/2008 |
| WO | WO 2016/017703 | A1 * | 2/2016 |

OTHER PUBLICATIONS

Chinese Office Action for Application No. 201380056947.8 dated Oct. 30, 2015.

Extended European Search Report for Application No. 13853144.7-1656 dated May 24, 2016.

International Preliminary Report on Patentability for PCT/JP2013/079818, dated Feb. 10, 2014, pp. 1-6.

* cited by examiner

RAZOR WITH ATTACHED SHAVING AID

RELATED APPLICATIONS

The present invention is a U.S. National Stage under 35 USC 371 patent application, claiming priority to Serial No. PCT/JP2013/079818, filed on 5 Nov. 2013; which claims priority from Japanese Patent Application No. 2012-244027, filed 6 Nov. 2012, the entirety of both of which are incorporated herein by reference.

BACKGROUND OF THE INVENTION

The present invention relates to a razor with an attached shaving aid capable of shaving body hairs grown on various skin surfaces of a body.

Patent Document 1 discloses a razor that includes a blade body attachment member having a blade body and a base member having a shaving aid. The base member is pivotally supported by the blade body attachment member. In addition, the base member is provided with a leaf spring that elastically holds the base member with respect to the blade body attachment member. When body hairs on a skin surface are shaved by using the razor, the base member pivots against the elastic force of the leaf spring so that frictional resistance between the shaving aid and the skin surface is reduced.

PRIOR ART DOCUMENT

Patent Document

Patent Document 1: Japanese Patent No. 4921747

SUMMARY OF THE INVENTION

The razor described in Patent Document 1 has a support structure in which the base member is pivotally supported by the blade body attachment member and elastically held by the leaf spring. Thus, this kind of razor has an increased number of components and requires assembly work of the base member with respect to the blade body attachment member, which increases the manufacturing costs. In addition, in the razor described in Patent Document 1, there is a possibility that the shaving aid will expand by absorbing water when used and project more than necessary. In this case, the shaving aid is pressed against the skin surface more than necessary, so that a cutting edge of the blade body is not properly brought into contact with the skin surface, degrading the shaving sensation.

Accordingly, it is an objective of the present invention to improve the shaving sensation with a razor provided with a shaving aid and simplify the support structure of the shaving aid.

In accordance with a first aspect of the present invention, a razor with an attached shaving aid is provided. The razor includes an attachment portion that includes a blade body and a shaving aid. The shaving aid includes a deformable portion that is deformable when contacted by a skin surface.

In this case, the shaving aid is deformed so that frictional resistance between the shaving aid and the skin surface when the razor is used is reduced. Thus, it is possible to improve the tactile sensation when the razor is brought into contact with the skin surface to improve the shaving sensation. Also, it is possible to simplify the support structure of the shaving aid.

The deformable portion of the shaving aid preferably includes a flexible part. In this case, the deformable portion of the shaving aid can be easily provided in the flexible part.

The deformable portion of the shaving aid preferably includes a thin-walled part. In this case, the deformable portion of the shaving aid can be easily provided in the thin-walled part.

The deformable portion of the shaving aid includes preferably a groove. In this case, the deformable portion of the shaving aid can be easily provided in the groove.

The shaving aid is preferably provided in the attachment portion. In this case, the shaving aid is integrally formed with the attachment portion so that the support structure of the shaving aid is simplified.

The shaving aid preferably includes an annular support portion and a non-support portion arranged inside the support portion, and the shaving aid is preferably supported by the attachment portion in the support portion but is not supported by the attachment portion in the non-support portion. Also, the deformable portion is preferably provided in the non-support portion. In this case, the shaving aid is supported in the annular support portion by the attachment portion, and the deformable portion of the shaving aid is provided in the non-support portion. The shaving aid thus can be easily deformed.

The shaving aid preferably includes a support portion and a non-support portion, and the shaving aid is preferably supported by the attachment portion in the support portion but is not supported by the attachment portion in the non-support portion. Also, the deformable portion is preferably provided in a part of the non-support portion that borders the support portion. In this case, the shaving aid is supported in the support portion by the attachment portion, and can be easily supported and deformed with respect to the attachment portion by varying the deformation degree of the shaving aid across the deformable portion.

In accordance with a second aspect of the present invention, a razor with an attached shaving aid is provided. The razor includes an attachment portion that includes a blade body and a shaving aid. The shaving aid includes an expansion reduction portion that reduces forward expansion of the shaving aid when the shaving aid contains moisture.

In this case, it is possible to prevent the shaving aid from expanding forward more than necessary. Thus, it is possible to prevent the shaving aid from being pressed against the skin surface more than necessary when the razor is used. It is also possible to improve the shaving sensation by allowing the cutting edge of the blade body to be properly brought into contact with the skin surface.

The expansion reduction portion of the shaving aid preferably includes a groove. In this case, the expansion reduction portion, which reduces forward expansion of the shaving aid, is easily provided in the groove.

In accordance with a third aspect of the present invention, a razor with an attached shaving aid is provided. The razor includes an attachment portion that includes a blade body and a shaving aid. The shaving aid is formed in a thin-walled shape, and front and rear sides of the shaving aid are exposed. In this case, the razor can be configured to allow the cutting edge of the blade body to be brought into contact with the skin surface on at least one of the sides in the thickness direction, for example.

In addition, the shaving aid expands forward and backward by absorbing water when the razor is used. Since the shaving aid does not expand only forward, but forward and backward, the expansion direction is split to enable the shaving aid to be prevented from expanding forward more than necessary. Thus, it is possible to prevent the shaving aid from being pressed against the skin surface more than necessary when the razor is used. It is also possible to improve the shaving sensation by allowing the cutting edge of the blade body to be properly brought into contact with the skin surface.

The attachment portion is preferably provided with a through hole that extends through the attachment portion, and the shaving aid is preferably provided between a pair of edge portions facing each other in a periphery of the through hole. In this case, it is possible to prevent the shaving aid from expanding outward of the through hole more than necessary. Thus, it is possible to prevent the shaving aid from being pressed against the skin surface more than necessary when the razor is used. It is also possible to improve the shaving sensation by allowing the cutting edge of the blade body to be properly brought into contact with the skin surface.

The blade body preferably includes a cutting edge in the attachment portion, and inclines such that the cutting edge is separated from the shaving aid. In this case, it is possible to easily create a space in which the shaving aid is provided in the attachment portion.

The shaving aid preferably includes portions that are different from each other in a deformation degree across the deformable portion. In this case, it is possible to easily support and deform the shaving aid with respect to the attachment portion by varying the deformation degree of the shaving aid across the deformable portion.

The shaving aid preferably includes a support portion and a non-support portion, and the shaving aid is preferably supported by the attachment portion in the support portion but is not supported by the attachment portion in the non-support portion. Also, the deformable portion is preferably provided in the non-support portion. In this case, the shaving aid can be supported in the attachment portion by the support portion, and can be easily deformed in the deformable portion of the non-support portion.

The non-support portion is preferably exposed on front and rear sides of the shaving aid. In this case, the razor can be configured to allow the cutting edge of the blade body to be brought into contact with the skin surface on at least one of the sides in the thickness direction, for example. In addition, since the shaving aid expands forward and backward by absorbing water when the razor is used, the expansion direction of the shaving aid is split to enable the shaving aid to be prevented from expanding forward more than necessary. Thus, it is possible to prevent the shaving aid from being pressed against the skin surface more than necessary when the razor is used. It is also possible to improve the shaving sensation by allowing the cutting edge of the blade body to be properly brought into contact with the skin surface.

The support portion preferably includes an upper portion and a lower portion, and the non-support portion is preferably provided between the upper portion and the lower portion. In this case, it is possible to easily support and deform the shaving aid with respect to the attachment portion.

The support portion is preferably formed in an annular shape, and the non-support portion is preferably provided inside the support portion. In this case, it is possible to easily support and deform the shaving aid with respect to the attachment portion.

The deformable portion is preferably provided in a part of the non-support portion that borders the support portion. In this case, it is possible to easily support and deform the shaving aid with respect to the attachment portion by varying the deformation degree of the shaving aid across the deformable portion.

A maximum thickness of the non-support portion is preferably set less than a maximum thickness of the support portion. In this case, it is possible to easily deform the non-support portion in the shaving aid.

A width of the blade body in a direction intersecting the cutting edge is preferably set to be maximum at a middle portion in an extending direction of the cutting edge of the blade body and to decrease toward opposite ends in the extending direction of the cutting edge of the blade body. In this case, since the shaving aid is provided with a wide middle portion in the extending direction of the cutting edge of the blade body, it is possible to improve the shaving sensation by allowing frictional resistance between the shaving aid and the skin surface to be easily reduced when the razor is used.

The shaving aid is preferably molded by injection molding to be provided in the attachment portion. In this case, the shaving aid can be easily molded integrally with the attachment portion.

The shaving aid is preferably molded with at least a water-soluble component and a water-insoluble component including soft plastic, and a weight ratio of the soft plastic contained in the water-insoluble component with respect to the whole shaving aid is preferably set to be more than a weight ratio of the water-soluble component with respect to the whole shaving aid. In this case, it is possible to provide a shaving aid that improves the shaving sensation.

DETAILED DESCRIPTION OF THE PREFERRED EMBODIMENTS

A razor according to one embodiment of the present invention will now be described with reference to the drawings.

Figure 1B:
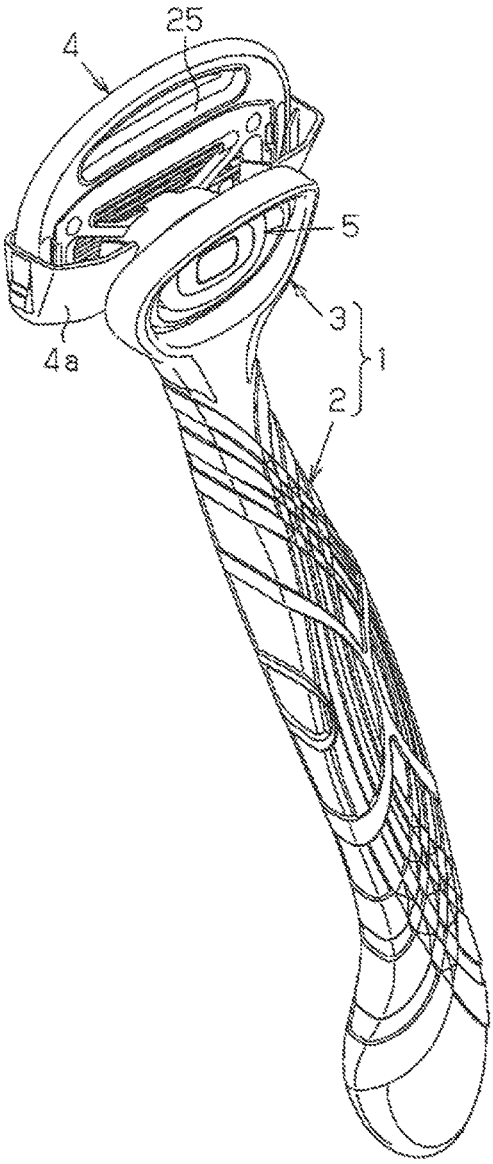
FIG. 1B is an overall rear perspective view of the pivoting head razor of FIG. 1A.
Figure 1A:
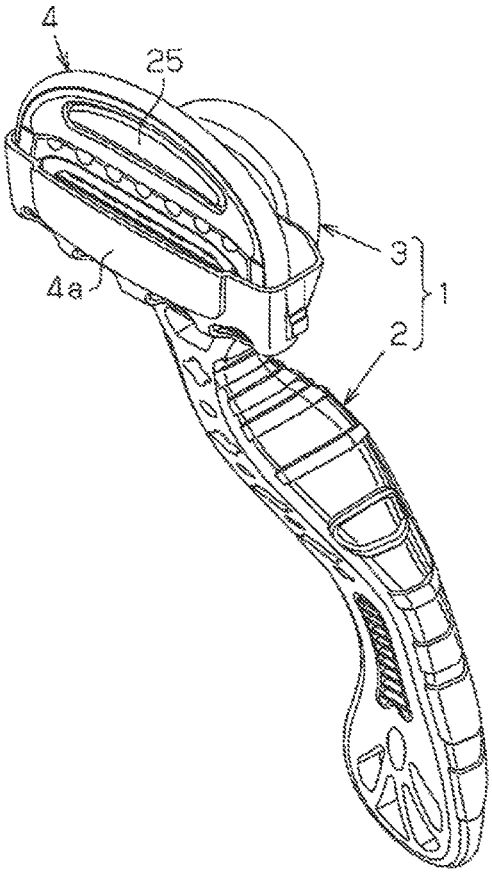
FIG. 1A is an overall front perspective view of a pivoting head razor on which a cap is attached at a neutral position of a razor head.

As shown in FIGS. 1A and 1B, the razor is provided with a holder 1, and the holder 1 includes a handle 2 and a top portion 3 provided at an upper end of the handle 2. In the front of the top portion 3, a razor head 4 is attached through a pivoting mechanism 5. A lower portion of the razor head 4 is detachably fitted from above into a cap 4*a*.

Figure 2B:
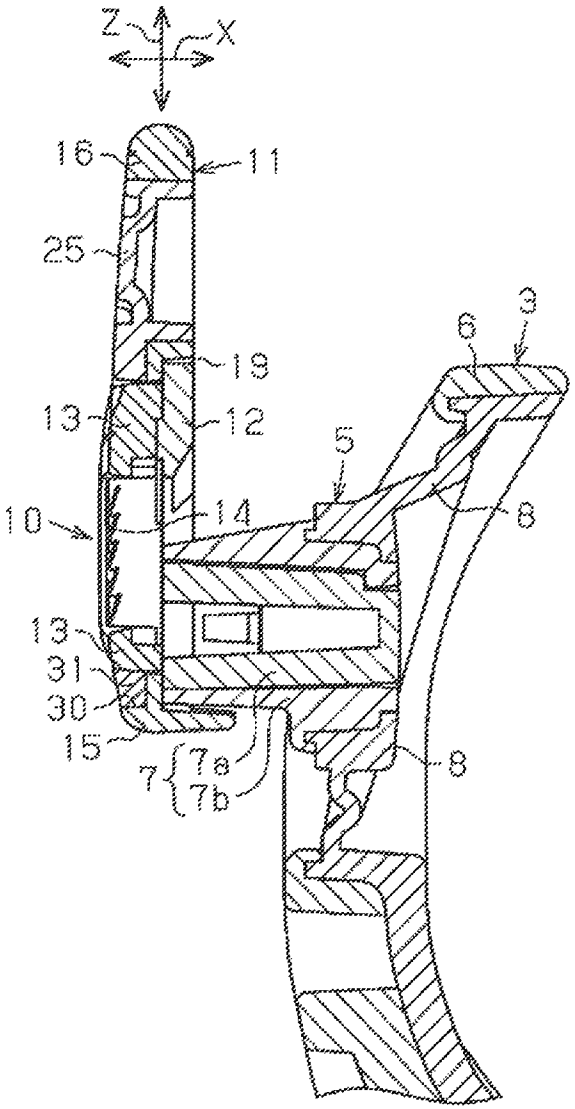
FIG. 2B is a partially enlarged cross-sectional side view of the pivoting head razor of FIG. 1A.
Figure 2A:
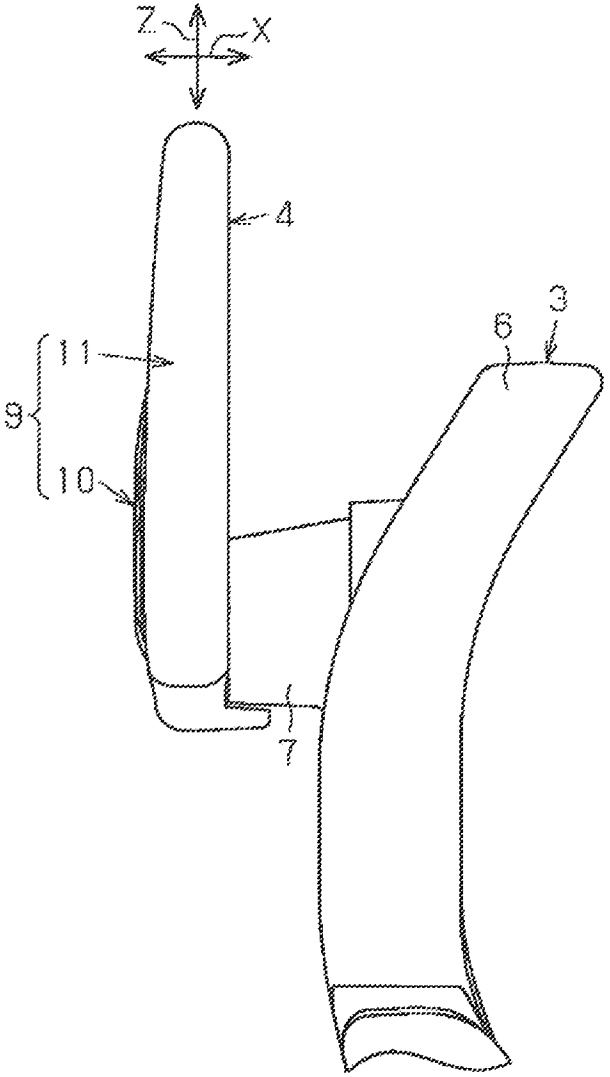
FIG. 2A is a partially enlarged side view showing a top portion of a holder and the razor head in the pivoting head razor of FIG. 1A.

As shown in FIGS. 2A and 2B, the top portion 3 of the holder 1 is provided with an annular supporting body 6. The razor head 4 is provided with a supported body 7. Between the supporting body 6 and the supported body 7, an annular elastic portion 8 is arranged. The pivoting mechanism 5 is composed of the supporting body 6, the supported body 7, and the elastic portion 8. The elastic portion 8 pushes the razor head 4 toward a neutral position of the razor head 4, so that the razor head 4 is at rest at the neutral position. The razor head 4 can be moved to any pivoted position tilted in any of three-dimensional directions from the neutral position against pushing force of the elastic portion 8. The three-dimensional directions include a direction in which the razor head 4 faces the front of the top portion 3.

Figure 3A:
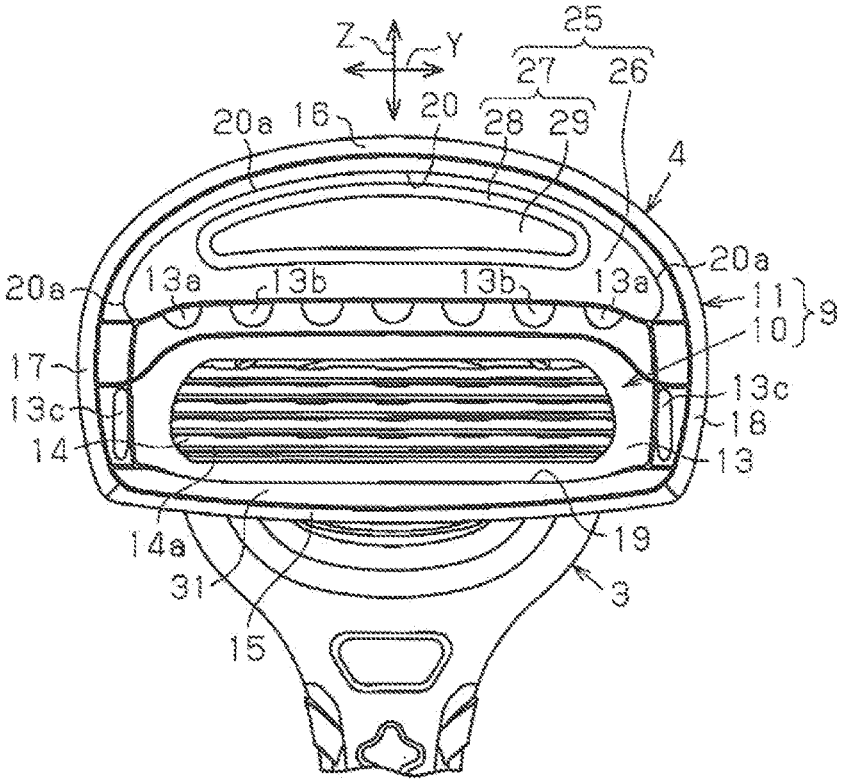
FIG. 3A is a partially enlarged front view showing the top portion of the holder and the razor head in the pivoting head razor of FIG. 1A.
Figure 3B:
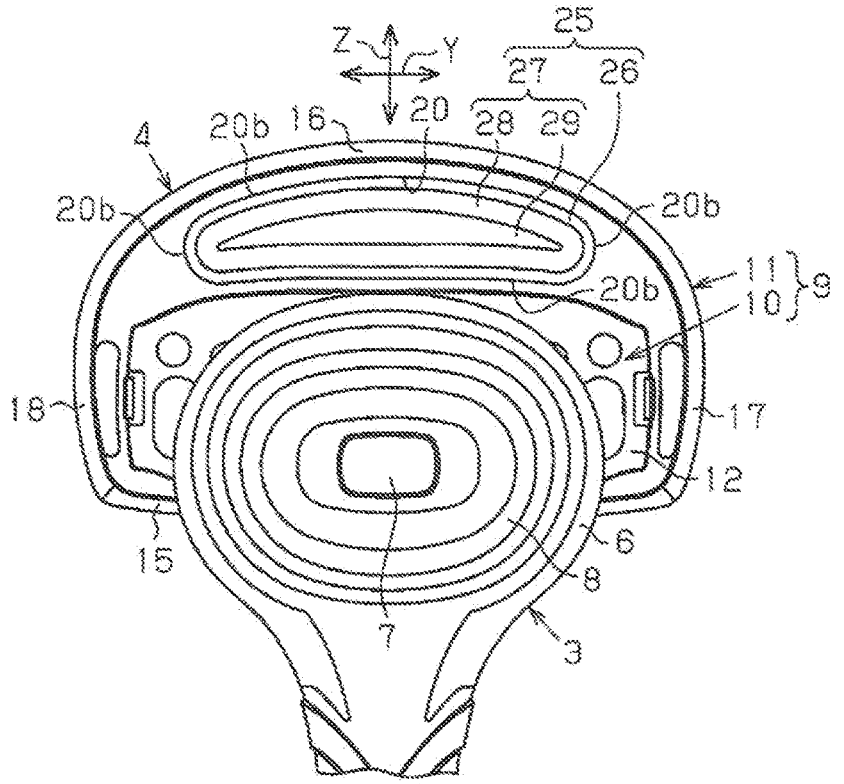
FIG. 3B is a partially enlarged rear view of the pivoting head razor of FIG. 1A.

As shown in FIGS. 2B, 3A, and 3B, the razor head 4 is provided with an attachment portion 9, and the attachment portion 9 includes a main body 10 and a frame body 11. The main body 10 of the attachment portion 9 includes a base portion 12, a covering portion 13, and a plurality of blade bodies 14 provided in a space between the base portion 12 and the covering portion 13. The supported body 7 includes a first coupling portion 7*a* projecting backward from the base portion 12, and a second coupling portion 7*b* attached to the elastic portion 8. The coupling portions 7*a* and 7*b* are coupled to each other. Accordingly, the attachment portion 9 is coupled to the top portion 3.

Each of the blade bodies 14 is provided at its tip with a cutting edge 14*a* extending in a lateral direction Y (hereinafter referred to as an extending direction Y). The cutting edges 14*a* are oriented downward in a vertical direction Z orthogonal to the extending direction Y (lateral direction) of the cutting edges 14*a* of the blade bodies 14. The frame body 11 of the attachment portion 9 includes: a lower outer frame portion 15 and an upper outer frame portion 16, which face each other in the vertical direction Z; and a left outer frame portion 17 and a right outer frame portion 18, which face each other in the extending direction Y (lateral direction) of the cutting edges 14*a* and connect the lower outer frame portion 15 and the upper outer frame portion 16 to each other. The outer frame portions 15, 16, 17, and 18 enclose and define an opening 19 that opens in a front-rear direction X. The main body 10 is fitted into the opening 19, and an outer periphery that connects lower, upper, left, and right portions of the main body 10 to each other is enclosed by the outer frame portions 15, 16, 17, and 18. The cutting edges 14*a* of the blade bodies 14 are exposed forward in the opening 19.

As shown in FIGS. 2B, 3A, 3B, 4, and 5, the frame body 11 is opened by being provided with a through hole 20 that is formed to extend through the upper outer frame portion 16 in the front-rear direction X (penetration direction). Between a front edge portion 20*a* and a rear edge portion 20*b* of the through hole 20 in a periphery of the through hole 20, there are provided a first inner portion 21 on the lower side, a second inner portion 24 on the upper side, a third inner portion 22 on the left side, and a fourth inner portion 23 on the right side. The third inner portion 22 includes a third inner surface 22*a*, which includes a stepped surface 22*b* between the front edge portion 20*a* and the rear edge portion 20*b*. The fourth inner portion 23 includes a fourth inner surface 23*a*, which includes a stepped surface 23*b* between the front edge portion 20*a* and the rear edge portion 20*b*. The second inner portion 24 includes a second inner surface 24*a*, which is formed over the whole surface between the front edge portion 20*a* and the rear edge portion 20*b* by extending to the third inner surface 22*a* and the fourth inner surface 23*a*. The first inner portion 21 includes a first inner surface 21*a* and a stepped surface 21*b* extending downward from the first inner surface 21*a*. The stepped surface 21*b* is stepped between the first inner surface 21*a* and an upper portion of the covering portion 13 of the main body 10.

In the inner portions 21, 22, 23, and 24 of the through hole 20, a shaving aid 25 is attached integrally with the frame body 11 of the attachment portion 9 by injection molding to be located between the front edge portion 20*a* and the rear edge portion 20*b*, which extend annularly. The shaving aid 25 contains a water-soluble component such as water-soluble polyethylene oxide, and a water-insoluble component including soft plastic such as elastomer resin. The weight ratio of the soft plastic included in the water-insoluble component with respect to the whole shaving aid 25 is set to be more than the weight ratio of the water-soluble component with respect to the whole shaving aid 25. The elastomer resin is set at a weight ratio of 30% or more (a weight ratio of 50% or more in an exemplary embodiment), and the water-soluble component is set at a weight ratio of 50% or less (a weight ratio of 15% in the exemplary embodiment).

Other parts than the blade bodies 14 in the razor head 4, namely the frame body 11 and the supported body 7 of the attachment portion 9, and the base portion 12 and the covering portion 13 of the main body 10, are molded with synthetic resin.

The shaving aid 25 includes: an annular support portion 26 that is attached to the inner surfaces 21*a*, 22*a*, 23*a*, and 24*a*, and the stepped surfaces 21*b*, 22*b*, and 23*b*, in the inner portions 21, 22, 23, and 24 of the through hole 20; and a non-support portion 27 that is formed inside the support portion 26. The support portion 26 and the non-support portion 27 are molded integrally with each other, and are exposed from the through hole 20 at both sides in the front-rear direction X (thickness direction). The support portion 26 includes: a coupling portion 26*a* attached to the inner surfaces 21*a*, 22*a*, 23*a*, and 24*a*; and a coupling portion 26*b* attached to the stepped surfaces 21*b*, 22*b*, and 23*b*. The coupling portion 26*b* attached to the stepped surface 21*b* is adjacent to the upper portion of the covering portion 13 of the main body 10. In the inside of the support portion 26, a cavity 26*c* is formed behind the non-support portion 27. The non-support portion 27 includes a deformable portion 28 that is annularly formed in a part bordering the support portion 26, and a movable portion 29 that is formed inside the deformable portion 28. The deformable portion 28 includes an annular groove 28*a* (expansion reduction portion), and an annular thin-walled part 28*b* (flexible part) that is thinned by forming the groove 28*a*. The movable portion 29 is bent forward in an inner periphery of the thin-walled part 28*b*. The cavity 29*a* is formed inside the thin-walled part 28*b*. The movable portion 29 expands to the front side of the cavity 29*a*, and is enclosed by the groove 28*a*. Front surfaces of the coupling portions 26*a* and 26*b* of the support portion 26 and a front surface of the movable portion 29 of the non-support portion 27 are arranged on a plane including the front edge portion 20*a* in the periphery of the through hole 20. A rear surface of the coupling portion 26*a* of the support portion 26 is arranged on a plane including the rear edge portion 20*b* in the periphery of the through hole 20. The maximum thickness of the non-support portion 27 is set less than the maximum thickness of the support portion 26. The width of the shaving aid 25 in the vertical direction Z intersecting the extending direction Y (lateral direction) of the cutting edges 14*a* is set to decrease toward the opposite ends in the extending direction Y, and is set to be maximum at a middle portion between the opposite ends.

Figure 4:
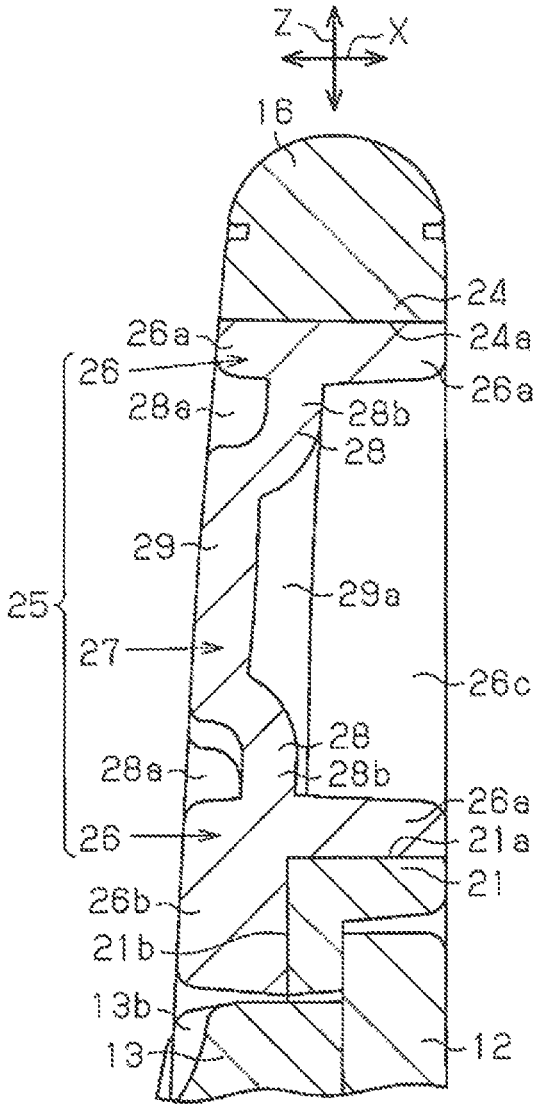
FIG. 4 is a partially enlarged longitudinal cross-sectional view of an upper shaving aid shown in FIG. 3A.
Figure 5:
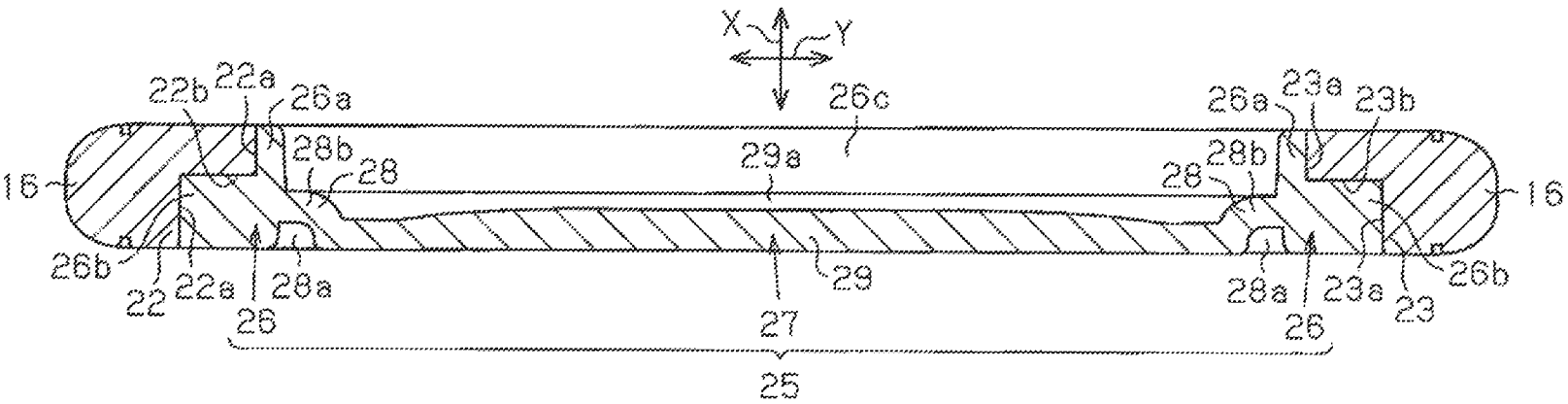
FIG. 5 is a partially enlarged horizontal cross-sectional view of the upper shaving aid shown in FIG. 3A.

As shown in FIGS. 1A, 3A, and 4, a pair of recessed portions 13*a* is arranged near respective ends in the lateral direction Y in an upper portion of the covering portion 13 of the main body 10. Between the recessed portions 13*a*, a plurality of recessed portions 13*b* is arranged side by side along the front edge portion 20*a* of the periphery of the through hole 20 in the lateral direction Y. That is, the upper portion of the covering portion 13 opens toward the shaving aid 25 in the recessed portions 13*a* and 13*b*. Although not illustrated, a surface of the covering portion 13 on which each of the middle recessed portions 13*b* is formed is positioned to be slightly displaced backward with respect to a surface of the covering portion 13 on which the recessed portions 13*a* at the opposite ends are formed. Thus, the water-soluble component melting from the shaving aid 25 and shaving aid material such as shaving foam applied to the skin in advance enter the middle recessed portions 13*b* and accumulate there more easily than the pair of recessed portions 13*a* arranged near the respective ends in the lateral direction Y.

On either side of the covering portion 13 of the main body 10 in the lateral direction Y, a belt-like protrusion 13*c* extending in the vertical direction Z is formed. The top surface of each protrusion 13*c* is positioned almost on a surface including the cutting edges 14*a* of the blade bodies 14. The protrusions 13*c* are brought into contact with the skin surface together with the cutting edges 14*a* when the razor is used to guide the razor head 4 in the vertical direction Z while stabilizing the razor head 4.

In addition, as shown in FIG. 2B, a stepped portion 30 is formed on a rear side of the lower outer frame portion 15 in the frame body 11. In the stepped portion 30, a shaving aid 31 is attached integrally with the frame body 11 of the attachment portion 9. The shaving aid 31 is simultaneously molded with the shaving aid 25 attached to the upper outer frame portion 16 by injection molding to be attached integrally with the frame body 11 of the attachment portion 9. The shaving aid 31 in the stepped portion 30 is adjacent to a lower portion of the covering portion 13 of the main body 10.

In FIGS. 3A and 3B, the attachment portion 9 of the razor head 4 (the main body 10 and the frame body 11) is set such that the maximum dimension in the lateral direction Y is about 48 mm, and the maximum dimension in the vertical direction Z is about 30 mm. In addition, in FIGS. 4 and 5, the maximum thickness of the support portion 26 of the shaving aid 25 is set at about 3 mm, and the maximum thickness of each of the thin-walled part 28*b* and the movable portion 29 of the non-support portion 27 of the shaving aid 25 is set at about 0.8 mm, preferably within a range from 0.5 mm to 1.5 mm.

Next, operation of the razor will be described with a focus on the shaving aids 25 and 31.

When body hairs are shaved with the razor in accordance with the present embodiment, the razor head 4 arranged at the neutral position is pressed against the skin surface. The razor head 4 tilts in accordance with the pressed direction against the pushing force of the elastic portion 8 of the pivoting mechanism 5 to reduce resistance when the body hairs are shaved. The shaving aids 25 and 31 of the razor head 4 are brought into contact with the skin surface while containing moisture so that the razor head 4 smoothly slides to improve the shaving sensation. Since the shaving aid 25, which includes the deformable portion 28 in the non-support portion 27, can be deformed at the groove 28*a* and the thin-walled part 28*b* of the deformable portion 28 by contact with the skin surface, the tactile sensation with respect to the skin surface is improved. In addition, since the shaving aid 25 includes the groove 28*a*, when containing moisture, the shaving aid 25 not only expands forward in the thickness direction X but also backward in the thickness direction X while expanding toward the inside of the groove 28*a*. As a result, the amount of expansion toward the front side of the shaving aid 25 is split, so that the pressure onto the skin surface with the expansion is reduced to further improve the shaving sensation.

The preferred embodiment has the following advantages.

(1) Since the shaving aid 25 itself is deformed to reduce frictional resistance between the shaving aid 25 and the skin surface when the razor is used, the tactile sensation with respect to the skin surface becomes better to improve the shaving sensation.

(2) Since the shaving aid 25 itself is deformed, it is possible to simplify the support structure of the shaving aid 25 as compared with a conventional razor in which a base member including a shaving aid pivots.

(3) The shaving aid 25 includes the groove 28*a* as an expansion reduction portion. Thus, when containing moisture, the shaving aid 25 not only expands forward in the thickness direction X but also backward in the thickness direction X while expanding toward the inside of the groove 28*a*. As a result, the shaving aid 25 is prevented from excessively expanding forward to reduce the pressure onto the skin surface with the expansion. Also, the cutting edges 14*a* of the blade bodies 14 are allowed to be properly and easily brought into contact with the skin surface, whereby the shaving sensation is improved.

The above illustrated embodiment may be modified as follows.

In the above illustrated embodiment, the pivoting mechanism 5 may be omitted, and the razor head 4 may be supported to be unable to pivot with respect to the top portion 3 of the holder 1.

In the above illustrated embodiment, the shaving aids 25 and 31 may be provided in the razor head 4 in which the main body 10 and the frame body 11 are integrally formed.

In the above illustrated embodiment, the shaving aid 31 of the razor head 4 may be omitted.

The shaving aid 25 may be provided in a portion other than the razor head 4, such as the holder 1 and the cap 4*a*.

DESCRIPTION OF THE REFERENCE NUMERALS

9 . . . attachment portion, 14 . . . blade body, 14*a* . . . cutting edge, 20 . . . through hole, 25 . . . shaving aid, 26 . . . support portion, 27 . . . non-support portion, 28 . . . deformable portion, 28*a* . . . groove (expansion reduction portion), 28*b* . . . thin-walled part (flexible part), X . . . thickness direction.

The invention claimed is:

1. A razor with an attached shaving aid comprising:

an attachment portion that includes a blade body;

wherein the shaving aid includes a deformable portion that is deformable when contacted by a skin surface, the shaving aid includes an annular support portion and a non-support portion arranged inside the support portion, the shaving aid is supported by the attachment portion in the support portion but is not supported by the attachment portion in the non-support portion, and the deformable portion is provided in the non-support portion.

2. The razor with an attached shaving aid according to claim 1, wherein the deformable portion of the shaving aid includes a flexible part.

3. The razor with an attached shaving aid according to claim 1, wherein the deformable portion of the shaving aid includes a thin-walled part.

4. The razor with an attached shaving aid according to claim 1, wherein the deformable portion of the shaving aid includes a groove.

5. The razor with an attached shaving aid according to claim 1, wherein the shaving aid is provided in the attachment portion.

6. The razor with an attached shaving aid according to claim 5, wherein the blade body includes a cutting edge in the attachment portion, and inclines such that the cutting edge is separated from the shaving aid.

7. The razor with an attached shaving aid according to claim 6, wherein a width of the shaving aid in a direction intersecting the cutting edge is set to be maximum at a middle portion in an extending direction of the cutting edge of the blade body and to decrease toward opposite ends in the extending direction of the cutting edge of the blade body.

8. The razor with an attached shaving aid according to claim 5, wherein the shaving aid includes portions that are different from each other in a deformation degree across the deformable portion.

9. The razor with an attached shaving aid according to claim 1, wherein the non-support portion is exposed on front and rear sides of the shaving aid.

10. The razor with an attached shaving aid according to claim 1, wherein the support portion includes an upper portion and a lower portion, and the non-support portion is provided between the upper portion and the lower portion.

11. The razor with an attached shaving aid according to claim 1, wherein the deformable portion is provided in a part of the non-support portion that borders the support portion.

12. The razor with an attached shaving aid according to claim 1, wherein a maximum thickness of the non-support portion is set less than a maximum thickness of the support portion.

13. The razor with an attached shaving aid according to claim 1, wherein the shaving aid is molded by injection molding to be provided in the attachment portion.

14. The razor with an attached shaving aid according to claim 1, wherein the shaving aid is molded with at least a water-soluble component and a water-insoluble component including soft plastic, and a weight ratio of the soft plastic contained in the water-insoluble component with respect to the whole shaving aid is set to be more than a weight ratio of the water-soluble component with respect to the whole shaving aid.

15. A razor with an attached shaving aid comprising:

an attachment portion that includes a blade body;

wherein the shaving aid includes a deformable portion that is deformable when contacted by a skin surface, the shaving aid includes an annular support portion and a non-support portion arranged inside the support portion, the shaving aid is supported by the attachment portion in the support portion but is not supported by the attachment portion in the non-support portion, and the deformable portion is provided in a part of the non-support portion that borders the support portion.

16. A razor with an attached shaving aid comprising:

an attachment portion that includes a blade body;

wherein the shaving aid includes a deformable portion that is deformable when contacted by a skin surface, the shaving aid includes an annual support portion and a non-support portion arranged inside the support portion, the shaving said is supported by the attachment portion in the support portion but is not supported by the attachment portion in the non-support portion, the attachment portion is provided with a through hole that extends through the attachment portion, and the shaving aid is provided between a pair of edge portions facing each other in a periphery of the through hole.

* * * * *